US005461194A

United States Patent [19]

Roop

[11] Patent Number: 5,461,194

[45] Date of Patent: Oct. 24, 1995

[54] GROUNDING CAGE APPARATUS

[76] Inventor: David W. Roop, c/o Virginia Power, P.O. Box 7507, Charlottesville, Va. 22906

[21] Appl. No.: 870,831

[22] Filed: Apr. 20, 1992

[51] Int. Cl.[6] ..... H01R 4/66

[52] U.S. Cl. ..... 174/6

[58] Field of Search ..... 174/6, 7, 1, 2, 174/3, 55 G

[56] References Cited

U.S. PATENT DOCUMENTS

| | | | |
|---|---|---|---|
| 362,062 | 5/1887 | Cole | 174/6 |
| 437,526 | 9/1890 | Spang | 174/2 |
| 1,193,848 | 8/1916 | Van Horn | 174/2 |
| 1,243,774 | 10/1917 | Soengen | 174/7 |
| 1,288,303 | 12/1918 | Vogel | 174/6 |
| 2,111,799 | 3/1938 | Newpher | 174/7 |
| 2,670,397 | 2/1954 | Covington | 174/6 |
| 2,683,765 | 7/1954 | Luecke | 174/6 |
| 3,012,089 | 12/1961 | Ridgers | 174/7 |
| 3,134,540 | 5/1964 | Shiepe | 235/61 B |
| 3,853,265 | 12/1974 | Kunert | 235/89 R |
| 5,043,527 | 8/1991 | Carpenter, Jr. | 174/2 |

FOREIGN PATENT DOCUMENTS

| | | | |
|---|---|---|---|
| 46-18416 | 5/1971 | Japan | 174/7 |
| 0752584 | 8/1980 | U.S.S.R. | 174/6 |

OTHER PUBLICATIONS

Simon, "Report on the Cage System of Lightning Protection", Dec. 1926, pp. 1–25.

"What's the Story?", EC&M, Aug. 1982, pp. 26, 32–35.

Verma et al., "Design of a Low Resistance Grounding System for a Hydro–Electric Plant Located on Highly Resistive Soils", IEEE, Sep./Oct. 1978, pp. 1760–1768.

Jones, "Bentonite Rods Assure Ground Rod Installation In Problem Soils", IEEE, Jul./Aug. 1980, pp. 1343–1346.

*Primary Examiner*—Leo P. Picard
*Assistant Examiner*—H. S. Sough
*Attorney, Agent, or Firm*—Cushman, Darby & Cushman

[57] ABSTRACT

A grounding apparatus is provided including a generally cylindrically-shaped grounding cage assembly which includes a plurality of vertically disposed, uniformly spaced grounding rods. Each of the grounding rods has a predetermined diameter and length. The grounding cage assembly also includes electrically conductive joining wire for joining the rods to form the cylindrical shape. In one embodiment, the grounding apparatus also includes a center rod assembly having a specific diameter and length disposed centrally within the cage assembly, and an electrically conductive joining element affixing the center rod assembly to the cage assembly. The diameter of the grounding cage assembly, the diameter and the length of the grounding rods, and the diameter and the length of the center rod assembly are pre-selected to cooperate to provide a predetermined desired overall ohmic value of the apparatus in soils having varying resistivity.

12 Claims, 2 Drawing Sheets

GROUNDING CAGE APPARATUS

BACKGROUND OF THE INVENTION

1. Field of the Invention

This invention relates to a grounding device for protecting electrical systems from voltage surges and for stabilizing voltage during normal operating conditions, and more particularly to a grounding cage apparatus for reducing electrical resistance, which is economical to manufacture and install. A method of providing effective grounding is also provided which utilizes the grounding cage apparatus. 2. Description of the Related. Art Various grounding methods have been employed to protect electrical systems from voltage surges due to lightning or the like. For example, conventional lightning rods, or the use of metal water piping and metal frames of buildings are typically employed for such grounding. Devices have been developed to potentially optimize grounding. For example, U.S. Pat. No. 2,111,799 discloses a grounding device having stacked rods driven deeply into the earth. However, mechanical stresses imposed while installing this type of device may result in failure of the device when exposed to subsequent fault current values. In addition, it is typical to arbitrarily install one set of ground rods after another until the desired ohmic value is obtained, which increases both cost and installation time.

Further, conventional grounding devices are not designed to accommodate soil of varying resistances. Thus, conventional multiple stacked ground rods may lose their low ohmic value when installed too deeply or too shallowly into the earth. For example, in high resistance soils (soils with a resistivity exceeding 50,000 ohms-cm) the depth of the grounding system must be extended to extreme distances to reach soil of suitable moisture to obtain a desirable resistance value. The cost to bore holes to achieve these depths, however, have become prohibitive in certain soils.

Accordingly, it can be appreciated that a need exists to provide an improved grounding apparatus employed in a grounding method which gives a calculated ohmic reduction for a particular type of soil, without requiring increased depth penetration of the full diameter of the device. Thus, it is desirable to provide a grounding apparatus, whereby the grounding effect in various soils can be determined in advance of installation.

SUMMARY OF THE INVENTION

An object of the present invention is to fulfill the need referred to above by providing a grounding apparatus which maximizes resistance reduction at minimum insertion depth.

Another object of the present invention is the provision of an apparatus of the type described, which is simple in construction, effective in operation and economical to manufacture and install.

In accordance with the principles of the present invention, these and other objectives are obtained by providing a grounding apparatus comprising a generally cylindrically-shaped grounding cage assembly which includes a plurality of vertically disposed, uniformly spaced grounding rods. Each of the grounding rods has a predetermined diameter and length. The grounding cage assembly also includes electrically conductive joining wire joining the rods to form the cylindrical shape. In one embodiment, the grounding apparatus also includes a center rod assembly having a specific diameter and length disposed centrally within the cage assembly, and an electrically conductive joining element affixing the center rod assembly to the cage assembly. The diameter of the grounding cage assembly, the diameter and the length of the grounding rods, and the diameter and the length of the center rod assembly are pre-selected to cooperate to provide a predetermined desired overall ohmic value of the apparatus in soils having varying resistivity.

Other objects, features and characteristics of the present invention, as well as methods of operation and functions of the related elements of structure, and the combination of the parts and economics of manufacture, will become more apparent upon the consideration of the following detailed description and appended claims with reference to the accompanying drawings, all of which form a part of this specification.

DETAILED DESCRIPTION OF THE PRESENTLY PREFERRED EXEMPLARY EMBODIMENT

Referring now more particularly to the drawings, shown is a grounding cage apparatus, generally indicated at 10, which embodies the principles of the present invention. The apparatus 10, includes a cage assembly, generally indicated at 12, a center rod assembly generally indicated at 18 and a joining wire 20.

Figure 1:
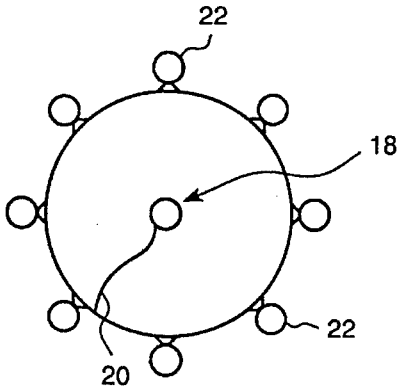
FIG. 1 is a top plan view of a grounding cage apparatus embodying the principles of the present invention, employing an optional center rod assembly.
Figure 3:
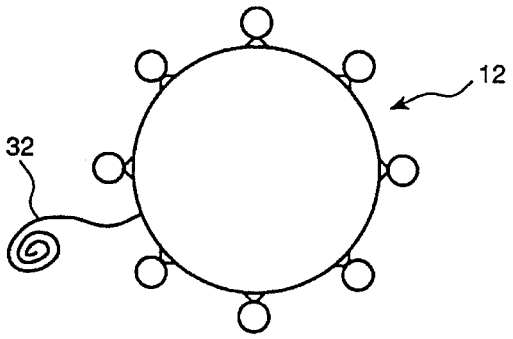
FIG. 3 is a top plan view of a grounding cage apparatus embodying the principles of the present invention, shown without the optional center rod assembly.
Figure 2:
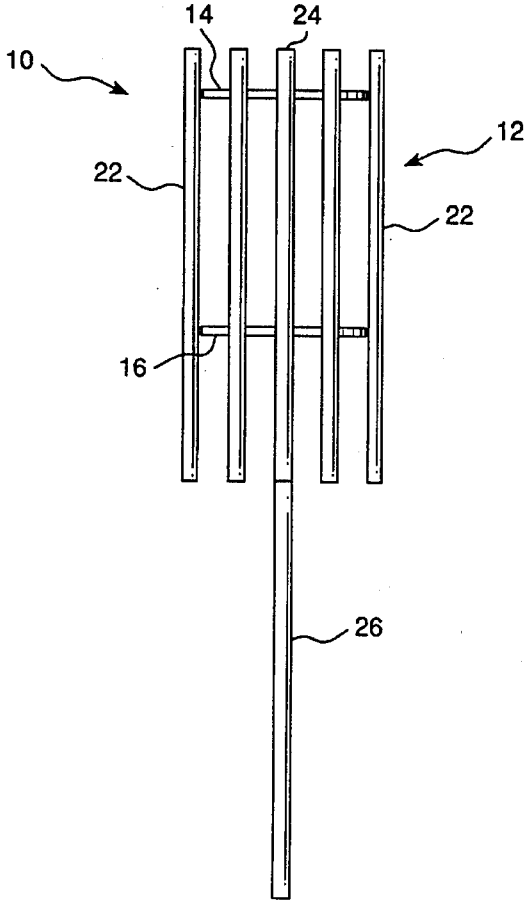
FIG. 2 is a front elevation of a grounding cage apparatus embodying the principles of the present invention, employing an optional center rod assembly.
Figure 4:
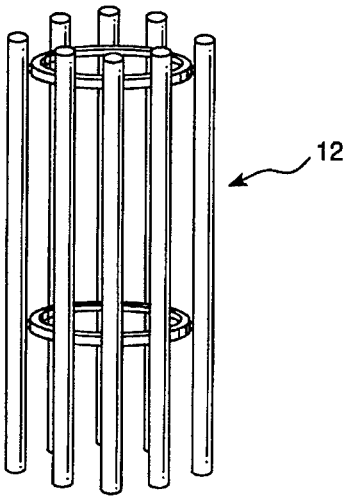
FIG. 4 is a front elevation of a grounding cage apparatus embodying the principles of the present invention, shown without the optional center rod assembly.
Figure 7:
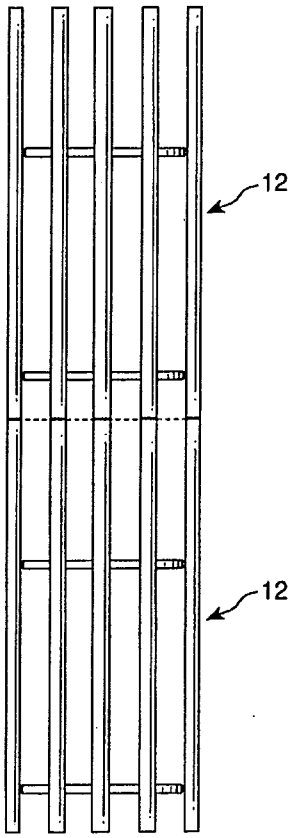
FIG. 7 is a front elevation of stacked cage assemblies embodying the principles of the present invention.

When fully assembled,, the apparatus 10 is of generally cylindrical configuration. As shown in FIG. 1, the cage assembly includes two connecting wires, top wire 14 and bottom wire 16 which defines the periphery thereof. The wires are preferably #2 or #4 gauge copper wire. To form the cage assembly 12, a plurality of uniformly spaced grounding rods 22 are affixed to the connecting wires 14, 16, as shown in FIGS. 1 and 2. The wires 14, 16 may be affixed to the grounding rods 22 in any known manner, for example with grounding clamps (not shown in particular). Preferably eight grounding rods are utilized, each having a diameter of ⅝ inch (0.625 inches or 1.59 cm) and a length of 6 feet (1.82 meters). The grounding rods 22 are disposed in parallel to form a parallel path for current flow and to reduce the resultant surge impedance of the apparatus. Each rod has a pointed end to aid in installing the apparatus 10. The use of the top and bottom connecting wires 14, 16 are desireable to keep cost at a minimum and form an equivalent electrical cylinder bonded on :both ends. This bonding is important to overall reduction in resistance.

Optionally, a center rod assembly 18 is centrally disposed within the cage assembly 12. The center rod assembly includes a first center rod 24 and a second center rod 26, removably affixed to end of the first center rod 24. Each center rod is also ⅝ of an inch (0.625 inches or 1.59 cm) in diameter, and each center rod is 6 feet (1.82 meters) in length. The function of the optional center rod assembly 18 will become more apparent below. When a center rod assembly is used, a joining wire 20, joins the center rod assembly to the cage assembly 12. In the preferred embodiment, the joining wire is #2 or #4 copper wire.

There are three factors that affect the ground electrode resistance. These factors are soil resistivity (greatly influenced by the soil moisture content), ground electrode depth, and ground electrode width (or surface area). The grounding cage apparatus 10 of the present invention mitigates the effects of soil resistivity. The overall outer diameter of the cage assembly 12 of the apparatus 10, is configured to maximize the resistance reduction at minimum depth, so as to reduce coupling requirements and for ease of installation. In the illustrative embodiment, the optimum diameter of the cage assembly 12 is in the 16 to 20 inch range. It has been determined that if the overall diameter of the cage assembly is increased., the resulting improvement in lowering the resistance is minimal. For example, a 200% increase in diameter reduces the resistance only 12%. In addition, if the diameter is reduced, the resulting increase in resistance is significant. For example, for a 50% reduction of diameter, the resistance increases more than 12%, and for a 75% reduction of diameter, the resistance increases more than 50%.

The use of the grounding cage apparatus 10 enables one to determine the worst possible ohmic value of the apparatus 10 prior to installation, due to the specific dimensions of the grounding cage apparatus 10. This greatly aids in estimating the cost required to obtain a desired overall resistance value.

The apparatus 10 is configured so as to be capable of being mathematically modeled on an expanded version of Whitehead's Nomograph. Whitehead's Nomograph is a graphical representation of various equations used to represent a complex multi-variable analysis in simplified form. The concept was developed by Dr. L. E. Whitehead and published in *Electric Light & Power*, "Nomograph Determines Ground-Rod Resistance", December, 1962. A Grounding Nomograph is shown in Table I. As shown, the relationship between the overall ohmic value of the apparatus 10 for a known value of soil resistance, are determined based upon known the diameter and depth of the cage assembly. To use the Nomograph, the following steps are required:

1. Select the cage dimension on the D scale (Example shown with 18 inch diameter as this is the nominal overall diameter of the apparatus 10).
2. Select the cage depth dimension on the L scale. (In uniform soil with a center rod inserted in apparatus 10, this value equals 10 feet. Example shows various depths of stacked cages in uniform soils).
3. Lay a straight edge on the selected L and D scale points so as to intersect with the Q scale.
4. Mark the Q scale point.
5. Lay a straight edge from the Q scale point and the resistance value of the soil at the location on the P scale. (Example assumes the soil value is 50,000 ohms-cm derived from testing using either a two-point or four-point method).
6. Extend the straight edge from the selected point on the Q scale through the resistance point on the P scale to intersect the resulting resistance value on the R scale.

Thus, by using the Nomograph, the resulting ground resistance of the cage assembly, in a particular soil, can be determined in advance of installation.

The insertion depth of the grounding cage apparatus 10 is critical. Two such apparatus 10 may be stacked to further reduce their effective resistance. Any additional depth beyond this amount results in reduced benefits. Doubling the insertion depth to 20 feet reduces the overall resistance in 50,000 ohm-cm soil by an additional, 40%. Tripling the insertion depth to 30 feet: improves the resistance value an additional 18% If the insertion depth were expanded to 40 feet, the resistance improvement would be 10% less than the 30 foot level. When compared to the 10 foot depth. Consequently, the present invention utilizes a design based on a ten foot insertion depth, with the option of stacking one apparatus 10 to obtain a 20 foot insertion depth if needed.

TABLE II

| | | | GROUNDING RECOMMENDATIONS BASED ON TEST ROD OHM VALUE | | |
|---|---|---|---|---|---|
| TEST ROD OHMS | SOIL RESISTIVITY (OHMS-CM) | 25 OHMS REQUIRES THIS ⅝INCH STACKED ROD DEPTH (FEET) | ONE ENHANCED GROUNDING CAGE (OHMS) | TWO STACKED ENHANCED GROUNDING CAGES (OHMS) | ADDITIONAL GROUNDING RECOMMENDATIONS (SEE NOTES) |
| >3000 | >200000 | >350 | 90 NOTE 2 | 60 NOTE 2 | 3 CAGES OR 2 STACKED CAGES |
| 3000 | 180000 | 350 | 90 NOTE 2 | 60 NOTE 2 | 3 CAGES OR 2 STACKED CAGES |
| 2000 | 100000 | 200 | 90 NOTE 2 | 60 NOTE 2 | 3 CAGES OR 2 STACKED CAGES |
| 1000 | 55000 | 140 | 90 NOTE 2 | 60 NOTE 2 | 3 CAGES OR 2 STACKED CAGES |
| 900 | 50000 | 90 | 90 NOTE2 | 60 NOTE 2 | 3 CAGES OR 2 STACKED CAGES |
| 800 | 45000 | 80 | 85 | 53 | 2 CAGES + 1 - 12 FT ROD OR 2 STACKED CAGES |

TABLE II-continued

| | | GROUNDING RECOMMENDATIONS BASED ON TEST ROD OHM VALUE | | | |
|---|---|---|---|---|---|
| TEST ROD OHMS | SOIL RESISTIVITY (OHMS-CM) | 25 OHMS REQUIRES THIS ⅝INCH STACKED ROD DEPTH (FEET) | ONE ENHANCED GROUNDING CAGE (OHMS) | TWO STACKED ENHANCED GROUNDING CAGES (OHMS) | ADDITIONAL GROUNDING RECOMMENDATIONS (SEE NOTES) |
| 700 | 40000 | 70 | 75 | 46 | 2 CAGES + 1 - 12 FT ROD OR 2 STACKED CAGES |
| 600 | 35000 | 58 | 65 | 40 | 2 CAGES OR 2 STACKED CAGES |
| 500 | 27000 | 45 | 53 | 31 | 2 CAGES OR 1 STACKED CAGE |
| 400 | 23000 | 35 | 43 | 23 | 1 CAGE |
| 300 | 15000 | 23 | 27 | 18 | 1 - 12 FT ROD OR 1 CAGE |
| 200 | 11000 | 16 | 23 | 14 | 1 - 12 FT ROD |
| 100 | 5000 | 6 | 9 | 6 | NO ADDITIONAL GROUNDING REQUIRED |

NOTE 1:
NESC requires 8 feet of minimum grounding. Additional grounding recommendations assumes 2 six-foot stacked rods are installed at the pole and homogeneous soil conditions exist. This grounding scheme should provide an overall ground value of 25 ohms. Test rod is ⅝inches in diameter and driven one foot in sod. Additional grounding recommendations assume same soil resistivity at each cage/rod location.
NOTE 2:
Cages are enhanced by doping soil with dry mortar mix. Dry mortar (350 lbs per single cage or 700 lbs per stacked cage) will reduce effective soil resistivity to 50000 ohms-cm after a 60 day period. Enhanced cage final resistance values are shown.

The grounding cage apparatus 10 of the present invention is configured to take advantage of both uniform and stratified (non-uniform) soil conditions in its depth component by using the optional center rod assembly 18. When installing the center rod assembly 18, the value of resistance of the device can be monitored using a clamp-on resistance tester. Depending on the soil conditions, the center rod may be excluded to minimize the overall resistance value.

Examples of installing the apparatus will be shown below. Once the soil resistivity is known, the number of these devices required to be installed and connected together to obtain the desired resistance can be determined in advance by using the Nomograph, as discussed above or a table derived from Nomographs of these cage assemblies in varying soil resistances as shown in Table II.

EXAMPLE 1

Center Rod Assembly Required

A center rod assembly is typically required when soil at the installation site is of uniform resistivity. Also, field tests have indicated that in certain areas, soil conditions may change in layers within 8 to 10 feet of the surface. The resistance values of the lower stratified soils may be significantly higher than the first 8 feet of soil. The apparatus is configured to obviate the problem exhibited in installing conventional grounding devices, wherein an increase in the overall resistance value may increase with insertion depth of the grounding device.

Figure 6:
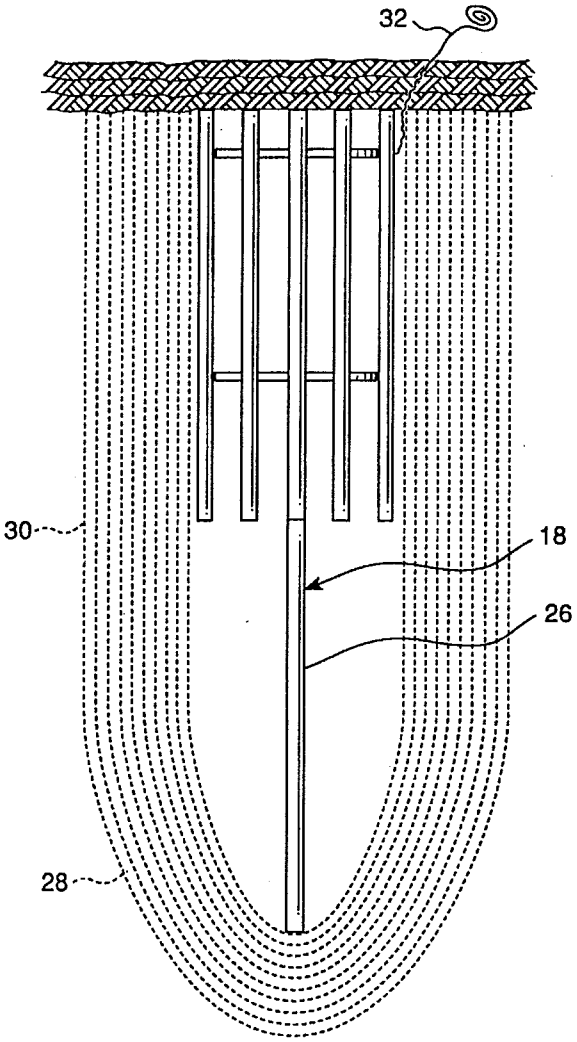
FIG. 6 is a front elevation of a grounding cage apparatus, with the optional center rod assembly, installed in soil of uniform resistivity.
Figure 5:
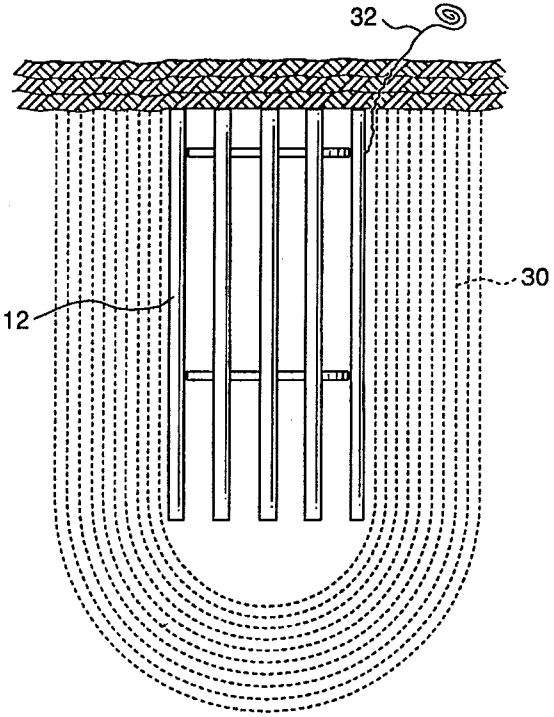
FIG. 5 is a front elevation of a grounding cage apparatus installed in soil of non-uniform resistivity.

The grounding cage apparatus 10 will not increase the overall resistance value when insertion depth is increased, since the optional center rod assembly 18 may be utilized. The center rod assembly 18 has two stacked center rods 24, 26 which are installed so that center rod 26 is driven up to 6 feet below the cage assembly 12. This center rod 26 utilizes the effect of the "sphere of influence" 28 of the center rod to extend the cage assembly's "sphere of influence" 30 an additional 4 feet (see FIGS. 5 and 6). The "sphere of influence" is an area which extends radially outward from an electrode, such as a grounding rod, which is affected by the electric charge which flows through the electrode. Such an effect enables one to obtain the benefit of a 10 foot cylindrical grounding apparatus when only a six foot cylindrical grounding apparatus is installed. Thus, the center rod assembly 18 furthers the effective influence of the cage assembly into the earth without having to extend the depth of the cage assembly 12. As one drives the center rod assembly through the cage assembly, one can monitor the overall resistance value with a clamp-on ground resistance tester. If the soil is stratified with higher resistance soil one can stop the insertion of or remove the center rod assembly in order to minimize the overall resistance value.

Installation of the apparatus 10 having a center rod assembly 18 is similar to the above installation. Once the cage assembly 12 is installed, the center rod assembly (including either one or two center rods) is driven though the center of the cage assembly 18. When two center rods are coupled, it is preferable to use contact paste at the coupling. Once the center rods are driven to the full insertion depth, the center rod assembly is tied to the cage assembly 12 by joining wire 20. Again, dry mortar may be employed in installations having high soil resistivity. A pig tail 32 is affixed to the apparatus 10 an brought to the earth's surface.

EXAMPLE 2

Center Rod Assembly Not Required

The center rod assembly 18 is typically not required when the apparatus is installed in non-uniform soil if the soil resistance increases with increased depth. To install the apparatus 10, an eight foot deep hole is augured in the earth at the desired installation site, with conventional equipment. The cage assembly 12 is then disposed in the hole. A pig tail 32 is affixed to the apparatus 10 and brought to the surface of the earth. If the soil has an extremely high resistivity, a permanent ground enhancement material may be used. Preferably, a dry mortar mix may be employed in connection with installing the apparatus 10. The type of mortar mix that has been found to be the most successful is "type N" mortar mix although any mortar mix will improve the overall ground resistance value if it is above 50,000 ohms-cm. The dry mortar mix forces the soil to model 50,000 ohms-cm resistance after 60 days, even if the true soil resistance value was initially much greater. The concept of improving a earth grounding scheme with soil enhancement is not unique in itself, however most designs assume that the soil enhancement material may need to be replenished over time. The present invention is designed so to not replenish this material but to utilize a permanent material if such ground enhancement is needed. Ground enhancement is provided only as an option and offers no real benefit for soils with resistance less than or equal to 50,000 ohms-cm. The ground cage apparatus design configuration is the primary determinate of the low resistance values in the lower resistant soils. If no soil enhancement is required, the apparatus may be covered with soil. The remaining hole is then filled to complete the installation.

The apparatus 10 works ideally when it is installed near the pole in the lowest resistance soil obtainable. A second apparatus 10 should be no closer than 12 feet to any other apparatus. When counterpoise installations are necessary, a first apparatus 10 should be located by the device pole, a second apparatus 10 should be located no greater than 150 feet from the first apparatus and a third apparatus 10 should be located no greater than 150 feet from the second apparatus. The attachment of these apparatus 10 in the counterpoise method allows for the connection of multiple pole grounds to the counterpoise grounding conductor.

As apparent above, the use of the center rod assembly 18 and the stacking of the apparatus 10 are options which must be determined by soil conditions and locations, but give the present invention inherent benefits over previous grounding methods.

While the invention ]has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A grounding apparatus comprising:

a generally cylindrically-shaped grounding cage assembly including:

a plurality of uniformly spaced grounding rods having a predetermined diameter and length, and means for joining said rods to form said cylindrical shape, said joining means being capable of conducting electrical current, a center rod assembly having a specific diameter and length disposed centrally within an interior of said cage assembly, and an electrically conductive joining element affixing said center rod assembly to said cage assembly, said diameter of said grounding cage assembly, said diameter and said length of said grounding rods, and said diameter and said length of said center rod assembly being pre-selected to cooperate to provide a predetermined maximum overall ohmic value of said apparatus when installed in soils having varying resistivity.

2. An apparatus as claimed in claim 1 wherein said center rod assembly includes first and second vertically disposed removably coupled center rods, and said cage assembly has a diameter between about 16 and 20 inches, and wherein each of said grounding rods and each of said center rods has a diameter of approximately 0.625 inches and a length of approximately 6 feet , said first center rod being disposed within an interior of said cage assembly and said second center rod extending beyond said interior of said cage assembly.

3. An apparatus as claimed in claim 1, wherein said means for joining said grounding rods and said electrically conductive joining element is #2 or #4 copper wire.

4. An apparatus as claimed in claim 1, wherein there are eight said grounding rods.

5. An apparatus as defined in claim 1, wherein said joining means includes a first wire joining said plurality of grounding rods adjacent one end of said cage assembly and a second wire joining said plurality of grounding rods adjacent an end of said cage assembly opposite said one end thereof.

6. A method of grounding electrical systems to protect the system from voltage surges or stabilize the voltage during normal operations comprising the sequential steps of:

(a) providing a grounding device having at least two generally cylindrically-shaped grounding cage assembly, each said grounding cage assembly including:

a plurality of vertically oriented, uniformly spaced grounding rods having a predetermined diameter and length, and means for joining said grounding rods to form said cylindrically-shaped grounding cage assembly so as to have a diameter between about 16 and 20 inches, said joining means being capable of conducting electrical current, (b) performing a soil resistivity test for determining soil resistivity in soil at an installation location, (c) determining an ohmic value of said grounding device based upon said soil resistivity and the length and diameter of said grounding cage assembly, (d) determining the number of said cage assemblies to be utilized based on the ohmic value expected for each individual cage assembly for particular soil resistance values, (e) augering a hole in the soil, (f) vertically stacking said grounding cage assemblies, (g) installing said grounding device into said hole, and (h) covering said grounding device with soil so as to completely bury said grounding device.

7. A method as claimed in claim 6, further comprising placing soil enhancement material into a center portion of said grounding device prior to the step of covering said grounding device with soil.

8. A method as claimed in claim 7, wherein said soil enhancing material is dry mortar mix.

9. A method of grounding electrical systems to protect them from voltage surges or stabilize the voltage during normal operations comprising the sequential steps of:

(a) providing a grounding device having a center rod assembly and at least one generally cylindrically-shaped grounding cage assembly, said grounding cage assembly including:

a plurality of vertically oriented, uniformly spaced grounding rods having a predetermined diameter and length, and means for joining said grounding rods to form said cylindrical shape, said joining means being capable of conducting electrical current, (b) performing a soil resistivity test for determining soil resistivity in soil at an installation location, (c) determining an ohmic value of said grounding device based upon said soil resistivity and the length and diameter of said grounding cage assembly, (d) determining the number of said cage assemblies to be utilized based on the ohmic value expected for each individual cage assembly for particular soil resistance values, (e) augering a hole in the soil, (f) inserting said grounding cage assembly into said hole, (g) driving said center rod assembly substantially vertically into the soil to a particular depth for achieving said ohmic value, said center rod assembly being disposed centrally within an interior of said grounding cage assembly after said driving, (h) tying said center rod assembly to said grounding cage assembly with electrically conductive material, (i) covering said grounding device with soil so as to completely bury said grounding device.

10. A method as claimed in claim 9, further comprising vertically stacking said grounding cage assemblies when said number is at least two, prior to said inserting step.

11. A method as claimed in claim 9, further comprising placing soil enhancement material into a center portion of said grounding device prior to the step of covering said grounding device with soil.

12. A method as claimed in claim 11, wherein said soil enhancing material is dry mortar mix.

* * * * *